US006511030B1

(12) United States Patent
Kelley

(10) Patent No.: US 6,511,030 B1
(45) Date of Patent: Jan. 28, 2003

(54) TOOTHBRUSH HOLDER ADAPTER

(75) Inventor: Drew Kelley, Buffalo, NY (US)

(73) Assignee: Robinson Knife Manufacturing Co., Inc., Buffalo, NY (US)

( * ) Notice: Subject to any disclaimer, the term of this patent is extended or adjusted under 35 U.S.C. 154(b) by 0 days.

(21) Appl. No.: 09/476,264

(22) Filed: Jan. 3, 2000

Related U.S. Application Data

(60) Provisional application No. 60/118,512, filed on Feb. 3, 1999.

(51) Int. Cl.[7] ..... A47F 5/00

(52) U.S. Cl. ..... 248/309.1; 248/71; 248/216.1; 248/312; 211/65; 211/66; D6/534

(58) Field of Search ..... 248/309.1, 312, 248/71, 217.3, 110, 111, 216.1, 300; 211/65, 66; D6/534

(56) References Cited

U.S. PATENT DOCUMENTS 837,871 A * 12/1906 Mcconnell et al. ..... 248/309.1
1,005,985 A * 10/1911 Lebherz ..... 248/309.1
2,956,851 A * 10/1960 Merendino ..... 248/309.1
2,997,210 A * 8/1961 Mackirdy ..... 248/71
3,199,816 A * 8/1965 Weisz ..... 248/71
3,977,743 A * 8/1976 Harris ..... 248/309.1
D278,777 S * 5/1985 Martin ..... 248/300
4,566,597 A * 1/1986 Caputo et al. ..... 211/87
4,865,281 A * 9/1989 Wollar ..... 248/71
5,259,519 A * 11/1993 Lieberman ..... 211/66
5,636,937 A * 6/1997 Zemlick ..... 248/388

* cited by examiner

*Primary Examiner*—Kimberly Wood
(74) *Attorney, Agent, or Firm*—Hedman & Costigan, P.C.

(57) ABSTRACT

A toothbrush holder adapter having an elongated body, an insertion member extending downwardly from a first end of the body to be inserted into a hole of a standard toothbrush holder and an opening at a second end of the body for receiving at least a portion of a toothbrush handle. The insertion member preferably includes extensions or fins to engage the interior of the opening of a standard toothbrush holder.

7 Claims, 2 Drawing Sheets

TOOTHBRUSH HOLDER ADAPTER

REFERENCE TO RELATED APPLICATION

This application is a regular utility application which claims priority to U.S. provisional application No. 60/118,512 filed Feb. 3, 1999.

FIELD OF THE INVENTION

This invention relates to an adapter for a toothbrush holder to hold toothbrushes with wider handles.

BACKGROUND OF THE INVENTION

Toothbrush holders generally have substantially circular openings of a standard size, usually about ⅝" in diameter. Lately, however, toothbrush manufacturers have been producing toothbrushes with ergonomic handles which, adversely are too wide to fit into the standard holes of a toothbrush holder. For this reason, persons are not storing these toothbrushes in holders as they should.

It is therefore an object of this invention to provide a device to allow a wide handle toothbrush to be stored in a standard toothbrush holder.

SUMMARY OF THE INVENTION

This and other objects are achieved by the present invention which is directed to a toothbrush holder adapter comprising an elongated body, an insertion member depending downwardly from a first end of said body and an opening in a second end of said body for accepting at least a portion of a toothbrush handle.

The insertion member is inserted into the standard opening of a common toothbrush holder and preferably has one or more engagement extensions to engage the underside or interior of a standard toothbrush holder hole. When the insertion member is fully inserted, one end of the body sits on the top surface of the toothbrush holder with the opening at the other end of the body extending outwardly beyond the end of the toothbrush holder. The wider handle toothbrush can then be placed into the adapter opening for storage.

BRIEF DESCRIPTION OF THE DRAWINGS

The following drawings, in which like reference characters indicate like parts, are provided for illustration of the invention and are not intended to limit the invention in any manner whatsoever.

DETAILED DESCRIPTION OF THE PREFERRED EMBODIMENT

Figure 1:
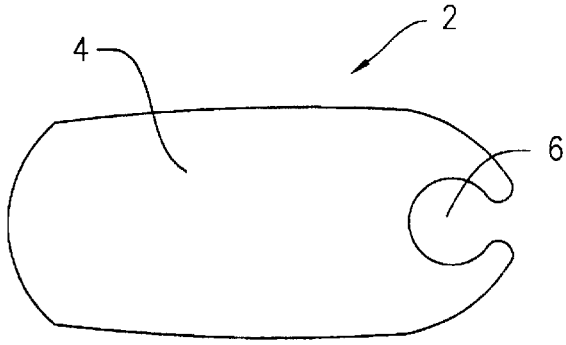
FIG. 1 is a plan view of the preferred toothbrush holder adapter of the present invention.
Figure 2:
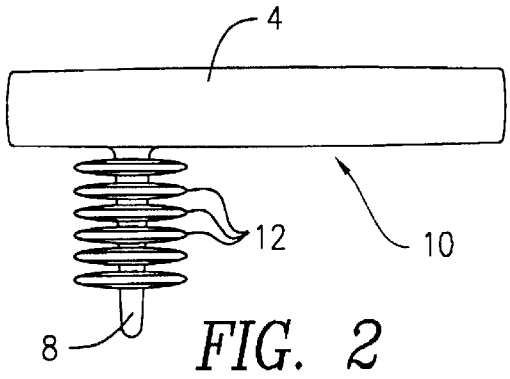
FIG. 2 is a side elevation of the preferred toothbrush holder adapter of the present invention.
Figure 3:
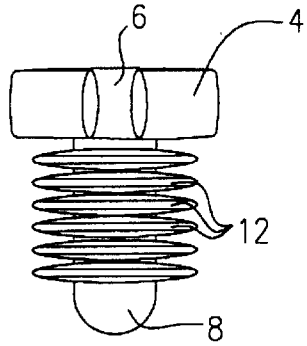
FIG. 3 is a front elevation of the preferred toothbrush holder adapter of the present invention.
Figure 4:
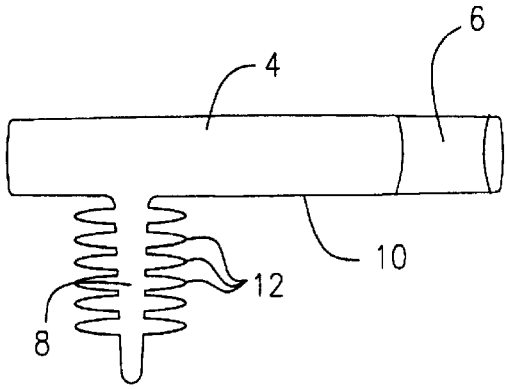
FIG. 4 is a cross-sectional elevation of the preferred toothbrush holder adapter of the present invention.
Figure 5:
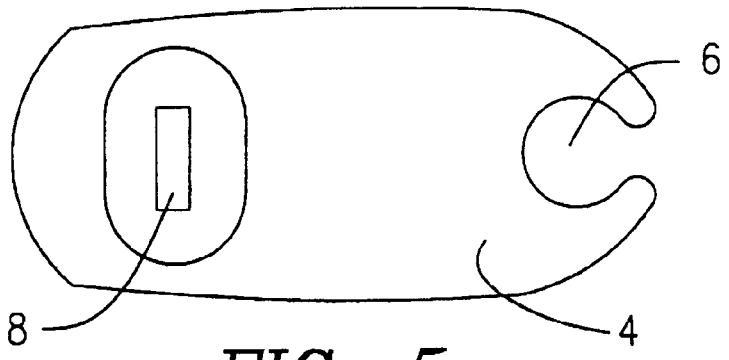
FIG. 5 is bottom view of the preferred toothbrush holder adapter of the present invention.

Referring to the drawings, and especially FIGS. 1–5, the toothbrush holder adapter 2 of the present invention includes a body 4 having an opening 6 therein for receiving a portion of a toothbrush handle (not shown). Depending downwardly from the body 4 is an insertion member 8 which is placed in a standard opening of a standard toothbrush holder (not shown).

When the insertion member 8 is placed fully within a standard toothbrush holder the bottom side 10 of the body 4 rests against the top surface of the standard toothbrush holder with the end of the body 4 having the opening 6 extending beyond the end of the standard toothbrush holder.

Figure 6:
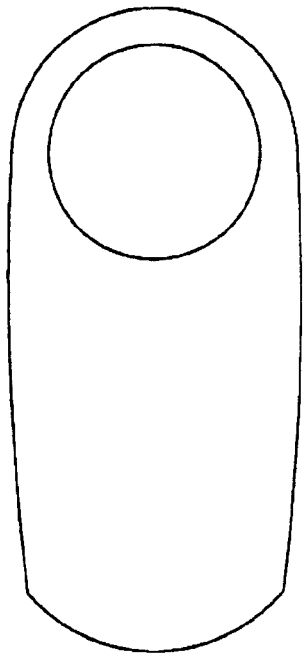
FIG. 6 is plan view of an alternative embodiment of the toothbrush holder adapter of the present invention.

The opening 6 can be a complete circle which is of a larger diameter than the standard hole of a standard toothbrush holder, as shown in FIG. 6, where the handle end of the toothbrush is inserted down into the opening. Preferably, however, as shown in FIGS. 1 and 3–5, the opening 6 comprises a C-shape which allows just the narrow neck portion of a wide handle toothbrush to pass into the opening 6. The head portion of the toothbrush (with the bristles thereon) then rests on the perimeter of the opening 6.

The insertion member 8 preferably has one or more engagement extensions or fins 12 thereon for engaging the interior or underside of the standard toothbrush holder. The engagement extensions 12 are preferably flexible enough so that they deflect when the insertion member 8 is pushed into the standard opening of the toothbrush holder and move back into shape to engage the interior or underside of the standard hole in the toothbrush holder. Preferably, a plurality of engagement extensions 12 are spaced substantially successively along at least a portion of the insertion member 8 to accommodate toothbrush holders having various thicknesses.

The toothbrush holder adapter 2 of the present invention can be made of various materials, including polypropylene, polyethylene, elastomers or rubber. However, it is preferred that the adapter be formed as a one piece unitary structure of elastomeric plastic by injection molding. Of course, the adapter 2 can be formed as more than one piece, such as with the body 4 formed independent of the insertion member 8. In such an embodiment, the insertion member 8 may be a material such as rubber having an end which can be locked into an aperture in the body 4.

Variations and modifications to the described invention will make themselves apparent to one skilled in the art reading this description. All such variations and modifications are intended to fall within the spirit and scope of the invention, limited solely by the appended claims.

What is claimed is:

1. A toothbrush holder adapter comprising an elongated body, an insertion member depending downwardly from a first end of said body and an opening in a second end of said body for accepting at least a portion of a toothbrush handle wherein said opening is axially disposed substantially parallel to the downwardly depending insertion member and further wherein said insertion member comprises a plurality of flexible engagement extensions spaced downwardly along at least a portion of the insertion member, each engagement extension extending outwardly from said insertion member.

2. The adapter of claim 1 wherein the engagement extensions are spaced substantially successively along at least a portion of the insertion member.

3. The adapter of claim 1 wherein the adapter is formed of a unitary material.

4. The adapter of claim 1 wherein the insertion member is formed separately from the body.

5. The adapter of claim 3 wherein the material is taken from the group consisting of polypropylene, polyethylene, elastomers and rubbers.

6. The adapter of claim 1 wherein the opening is bounded on all sides by the body.

7. The adapter of claim 1 wherein the opening forms a C-shape at the second end of the body.

* * * * *